US011019900B1

(12) United States Patent
Sellers et al.

(10) Patent No.: US 11,019,900 B1
(45) Date of Patent: Jun. 1, 2021

(54) HANDHELD APPARATUS FOR HAIR AND BODY WRAPS

(71) Applicant: I & E Capital, LLC, Waxhaw, NC (US)

(72) Inventors: Ellen Rucker Sellers, Waxhaw, NC (US); Ione Rucker Jamison, Waxhaw, NC (US)

( * ) Notice: Subject to any disclaimer, the term of this patent is extended or adjusted under 35 U.S.C. 154(b) by 574 days.

(21) Appl. No.: 15/984,615

(22) Filed: May 21, 2018

Related U.S. Application Data

(60) Provisional application No. 62/508,504, filed on May 19, 2017.

(51) Int. Cl.

| | |
|---|---|
| ***A45D 19/02*** | (2006.01) |
| ***A46B 5/00*** | (2006.01) |
| ***B65D 83/08*** | (2006.01) |
| ***A46B 15/00*** | (2006.01) |
| ***A45D 2/12*** | (2006.01) |
| *A45D 2/00* | (2006.01) |

(52) U.S. Cl.
CPC ..... *A45D 2/127* (2013.01); *A45D 19/02* (2013.01); *A46B 5/0095* (2013.01); *A46B 15/0055* (2013.01); *B65D 83/0805* (2013.01); *A45D 2002/007* (2013.01); *A45D 2200/25* (2013.01); *A46B 2200/104* (2013.01)

(58) Field of Classification Search
CPC ..... A45D 2002/007; A45D 2002/003; A45D 2200/25; A45D 33/003; A45D 33/26; A45D 40/24; A45D 40/265; A45D 19/0008; A45D 19/0025; A45D 19/0066; A45D 19/02; B65H 35/002; B65H 35/006; B65D 83/0805; A46B 2200/104; A46B 5/0095; A46B 15/0055
See application file for complete search history.

(56) References Cited

U.S. PATENT DOCUMENTS

| | | | | |
|---|---|---|---|---|
| 4,197,608 A * | 4/1980 | Holley | A45D 20/48 132/118 |
| 5,412,828 A * | 5/1995 | Kuhlmey | A46B 7/10 15/159.1 |
| 2003/0205602 A1* | 11/2003 | Huang | B65H 35/002 225/43 |

(Continued)

FOREIGN PATENT DOCUMENTS

| | | | |
|---|---|---|---|
| FR | 2931637 | * | 5/2008 |
| WO | WO 2014167284 | * | 3/2014 |

*Primary Examiner* — Yogesh P Patel
*Assistant Examiner* — Jennifer Gill
(74) *Attorney, Agent, or Firm* — Chad D. Tillman; Tillman Wright, PLLC

(57) ABSTRACT

An apparatus for applying wraps includes a handle, an arbor, a roll of material received on the arbor; and a tubular attachment having an interior space within which the arbor and roll are received. The first tubular attachment includes a slot through which material from the roll is dispensed and a slidable panel for opening and closing passage through the slot. A second tubular attachment also defines an interior space for receiving the arbor and comprises elongate protuberances defining a brush for brushing hair. Preferably the first and second tubular attachments are releasably mountable, interchangeably, and mutually exclusive in their mounting to a base of the apparatus from which the arbor extends.

18 Claims, 9 Drawing Sheets

(56) References Cited

U.S. PATENT DOCUMENTS

| | | | | |
|---|---|---|---|---|
| 2005/0005755 | A1* | 1/2005 | Turvey | B65D 83/0882<br>83/614 |
| 2006/0026783 | A1* | 2/2006 | McKay | A45D 19/02<br>15/104.94 |
| 2019/0387862 | A1* | 12/2019 | Duarte De Baez | A45D 26/0014 |

* cited by examiner

HANDHELD APPARATUS FOR HAIR AND BODY WRAPS

CROSS-REFERENCE TO RELATED APPLICATION

The present application is a U.S. nonprovisional patent application of, and claims priority under 35 U.S.C. § 119(e) to, U.S. provisional patent application 62/508,504, filed May 19, 2107, which provisional patent application including the Appendix thereof is incorporated by reference herein.

COPYRIGHT STATEMENT

All of the material in this patent document, including the computer program listing, is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

COMPUTER PROGRAM LISTING

Submitted concurrently herewith via the USPTO's electronic filing system, and incorporated herein by reference, is a computer program listing including electronic files and instructions for use on a computer. A table setting forth the name and size of files included in the computer program listing is included below.

| File Name | Creation Date | File Size (bytes) |
|---|---|---|
| ASCIFY.TXT | May 16, 2017 18:45 | 37,473 |
| README.TXT | May 16, 2017 18:45 | 2,582 |
| CODE.TXT | Sep. 16, 2017 18:45 | 1,282,703 |

One of these files, "readme.txt", contains instructions for extracting information from another file. This other file represents a compressed binary file that has been converted to ascii format. This file can be converted back to a compressed .zip archive utilizing an assembly conversion program source code for which is contained in "ascify.txt". The readme file includes instructions for compiling and running this conversion program, and instructions for converting the other text file to a compressed, binary file. This compressed, binary file includes a ".STP" file titled "HAIRBRUSH ROLL ASSEMBLY 1.0". A preferred embodiment of the invention is disclosed in detail in this file, which can be opened utilizing various STP viewer programs that are readily available both online and for download.

BACKGROUND OF THE INVENTION

The invention generally relates to methods and apparatus for hair and body wraps and, in particular, to methods and apparatus for applying hair wraps during hair styling, as well as for applying body wraps to body parts during spa treatments.

For example, over the life of highlighting, coloring, and conditioning, plastic and foil wraps have become a staple. The plastic or foil material for the wraps usually come in large rolls that are hard to manage, or small sheets that are not long enough to cover long hair. Furthermore, a stylist is known to perform a particular treatment called "Silk Wrapping", in which the stylist wraps "Saran wrap" (i.e., cling wrap) around a client's hair and then places the client underneath a hooded dryer.

Unfortunately, pulling out large rolls of wrap for a service can be awkward. Large rolls of wrap also occupy lots of space, and it can be difficult to maneuver such rolls when wrapping the material of the rolls around a head or body part. Moreover, it is believed that, while effective, the treatment may appear unorthodox and may embarrass the stylist, the client, or both, when a large roll of plastic wrap is pulled out for use.

In view of the foregoing, it is believed that needs exist for improvements in applying wraps. It further is believed that one or more such needs may be addressed by using a brush apparatus in accordance with one or more aspects and features of the invention that looks stylish and that is transformable into an instrument for applying wraps that is efficient and practical with silk wrappings, as well as highlighting, coloring, conditioning, and other treatments of the hair and body. It is believed that such a brush apparatus will improve efficiency in common salon and spa practices, as well as make such practices more manageable, hygienic, and pleasing to the eye.

SUMMARY OF THE INVENTION

The invention includes many aspects and features. Moreover, while many aspects and features relate to, and are described in, the context of hair styling as part of commercial salon services, the invention is not limited to use only in such context, as will become apparent from the following summaries and detailed descriptions of aspects, features, and one or more embodiments of the invention. Indeed, the invention has applicability in commercial spa services as well as in the consumer home-use context.

Accordingly, in an aspect of the invention, an apparatus for applying hair wraps during hair styling—including highlighting, coloring, conditioning, and drying of hair—comprises a brush handle, a brush attachment, and a wrap attachment that is interchangeable with the brush attachment, each of which is configured to be removably attached to the brush handle.

In another aspect of the invention, an apparatus comprises an elongate member; a first tubular attachment; and a second tubular attachment; wherein the first tubular attachment and the second tubular attachment are configured for releasable mounting to the elongate member and are interchangeable with one another.

Preferably, the elongate member has a proximal end and a distal end and comprises a handle for grasping by hand and an arbor for receiving a roll of material. The handle extends from the proximal end in a direction toward the distal end, and the arbor extends from the distal end in a direction toward the proximal end.

Preferably, the first tubular attachment has an open end and defines an interior space for receiving therein the arbor, and the second tubular attachment also has an open end and defines an interior space for receiving therein the arbor.

Furthermore, preferably the interior space of the first tubular attachment is configured to receive the arbor therein with a roll of material received on the arbor, and the first tubular attachment is configured for dispensing material from the roll and comprises a surface defining a slot having an opening for passage of the material through the slot from the interior space during unwinding of the roll.

Further in this regard, the first tubular member preferably comprises a panel that is slidable between an open configuration for providing passage of the material through the slot during unwinding of the roll, and a closed configuration for blocking passage of the material through the slot.

The interior space of the second tubular attachment preferably is configured for brushing hair and comprises a plurality of elongate protuberances, each having a distal end extending from a surface of the second tubular attachment.

In a feature, the apparatus comprises a roll of material that is received on the arbor and that is configured to rotate on the arbor during unwinding of material from the roll.

In another feature, the releasable mounting of the first tubular attachment and the releasable mounting of the second tubular attachment are mutually exclusive.

In another feature, the handle and the arbor collectively are defined by a single piece of molded material.

In another feature, the material comprises a film.

In another feature, the material comprises a foil.

In another feature, the distal end of the elongate member comprises a first threaded fastener and a distal end of the first tubular attachment comprises a second, complementary threaded fastener that is configured to mate with the first threaded fastener.

In another feature, the distal end of the elongate member comprises a first threaded fastener, and a distal end of the second tubular attachment comprises a second, complementary threaded fastener that is configured to mate with the first threaded fastener.

In additional features, the distal end of the elongate member comprises a first threaded fastener; a distal end of the first tubular attachment comprises a second, complementary threaded fastener configured to mate with the first threaded fastener; and a distal end of the second tubular attachment comprises a third, complementary threaded fastener configured to mate with the first threaded fastener. The first threaded fastener may comprise a threaded female fastener, and the second and third threaded fasteners each may comprise a threaded male fastener. In at least some embodiments, the threaded female fastener comprises an opening and interior threaded walls, and the second and third threaded fasteners each comprises a threaded shaft or a cylindrical wall having an outer threaded surface; and in at least some embodiments, the second threaded fastener extends from an interior surface at a distal end of the first tubular attachment toward the open end of the first tubular attachment; and the third threaded fastener extends from an interior surface at a distal end of the second tubular attachment toward the open end of the second tubular attachment.

In another feature, the handle and the arbor are coaxial with respect to a longitudinal axis of the elongate member. Furthermore, a portion of the distal end of the elongate member may comprise a circular opening with a center located on the longitudinal axis. In at least some embodiments, an inner surface of the portion of the elongate member defining the circular opening is threaded and is configured to receive a threaded portion of the first tubular attachment when in covering relation to the arbor; and an inner surface of the portion of the elongate member defining the circular opening is threaded and is configured to receive a threaded portion of the second tubular attachment.

In another feature, the apparatus further comprises a base from which the arbor extends and which the open end of the first tubular attachment abuts when attached to the distal end of the elongate member. The open end of the second tubular attachment also preferably abuts the base when attached to the distal end of the elongate member.

In another feature, the first tubular attachment comprises an edge defining a portion of the slot opening that is configured to facilitate cutting of the material when the panel is slid into the closed configuration with unwound material passing through the slot.

In another feature, the interior space defined by the second tubular attachment is configured to receive therein the arbor with the roll of material received on the arbor.

In another aspect, an apparatus comprises an elongate member having a proximal end and a distal end, and comprising a handle for grasping by hand and extending from the proximal end in a direction toward the distal end, and an arbor for receiving a roll of material and extending from the distal end in a direction toward the proximal end; a first tubular attachment having an open end and defining an interior space for receiving therein the arbor, the first tubular attachment comprising a surface defining a slot having an opening for passage through the slot from the interior space, and a panel slidable between an open configuration for providing passage through the slot, and a closed configuration for blocking passage through the slot; and a second tubular attachment having an open end and defining an interior space for receiving therein the arbor, the second tubular attachment comprising a plurality of elongate protuberances each having a distal end extending from an outer surface of the second tubular attachment. The first tubular attachment and the second tubular attachment each is configured for releasable mounting to the elongate member with the arbor received within the interior space thereof. Preferably, the first tubular attachment and the second tubular attachment are interchangeable with one another.

Another aspect comprises a method of using an apparatus for applying a wrap in accordance with one or more aspects and features disclosed herein.

Another aspect comprises a method of manufacturing an apparatus for applying a wrap in accordance with one or more aspects and features disclosed herein.

Additional aspects and features are disclosed in the computer program listing, which aspects and features are incorporated herein by reference.

In addition to the aforementioned aspects and features of the invention, it should be noted that the invention further encompasses the various logical combinations and subcombinations of such aspects and features. Thus, for example, claims in this or a divisional or continuing patent application or applications may be separately directed to any aspect, feature, or embodiment disclosed herein, or combination thereof, without requiring any other aspect, feature, or embodiment.

BRIEF DESCRIPTION OF THE DRAWINGS

One or more preferred embodiments of the invention now will be described in detail with reference to the accompanying drawings, wherein the same elements are referred to with the same reference numerals.

DETAILED DESCRIPTION

Figure 1:
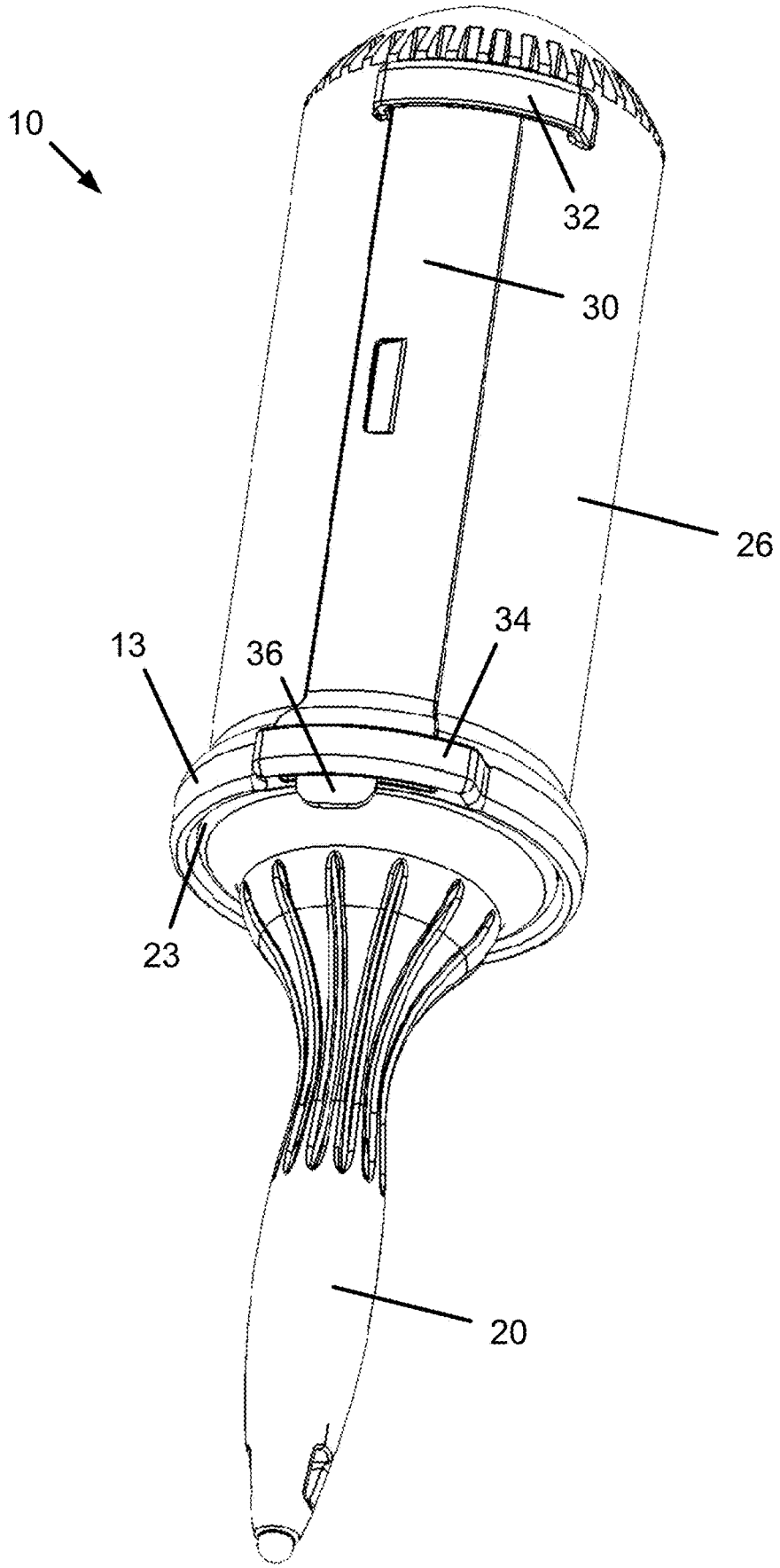
FIG. 1 is a perspective view of an apparatus in accordance with a preferred embodiment of one or more aspects and features of the invention.

As a preliminary matter, it will readily be understood by one having ordinary skill in the relevant art ("Ordinary Artisan") that the invention has broad utility and application. Furthermore, any embodiment discussed and identified as being "preferred" is considered to be part of a best mode contemplated for carrying out the invention. Other embodiments also may be discussed for additional illustrative purposes in providing a full and enabling disclosure of the invention. Furthermore, an embodiment of the invention may incorporate only one or a plurality of the aspects of the invention disclosed herein; only one or a plurality of the features disclosed herein; or any combination thereof. As such, many embodiments are implicitly disclosed herein and fall within the scope of what is regarded as the invention.

Accordingly, while the invention is described herein in detail in relation to one or more embodiments, it is to be understood that this disclosure is illustrative and exemplary of the invention, and is made merely for the purposes of providing a full and enabling disclosure of the invention. The detailed disclosure herein of one or more embodiments is not intended, nor is to be construed, to limit the scope of patent protection afforded the invention in any claim of a patent issuing here from, which scope is to be defined by the claims and the equivalents thereof. It is not intended that the scope of patent protection afforded the invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the invention. Accordingly, it is intended that the scope of patent protection afforded the invention be defined by the issued claim(s) rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

With regard solely to construction of any claim with respect to the United States, no claim element is to be interpreted under 35 U.S.C. 112(f) unless the explicit phrase "means for" or "step for" is actually used in such claim element, whereupon this statutory provision is intended to and should apply in the interpretation of such claim element. With regard to any method claim including a condition precedent step, such method requires the condition precedent to be met and the step to be performed at least once during performance of the claimed method.

Furthermore, it is important to note that, as used herein, "a" and "an" each generally denotes "at least one", but does not exclude a plurality unless the contextual use dictates otherwise. Thus, reference to "a picnic basket having an apple" describes "a picnic basket having at least one apple" as well as "a picnic basket having apples". In contrast, reference to "a picnic basket having a single apple" describes "a picnic basket having only one apple".

When used herein to join a list of items, "or" denotes "at least one of the items", but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers". When used herein to join a list of items, "and" denotes "all of the items of the list". Thus, reference to "a picnic basket having cheese and crackers" describes "a picnic basket having cheese, wherein the picnic basket further has crackers", as well as describes "a picnic basket having crackers, wherein the picnic basket further has cheese".

Referring now to the drawings, one or more preferred embodiments of the invention are next described. The following description of one or more preferred embodiments is merely exemplary in nature and is in no way intended to limit the invention, its implementations, or uses.

Figure 2:
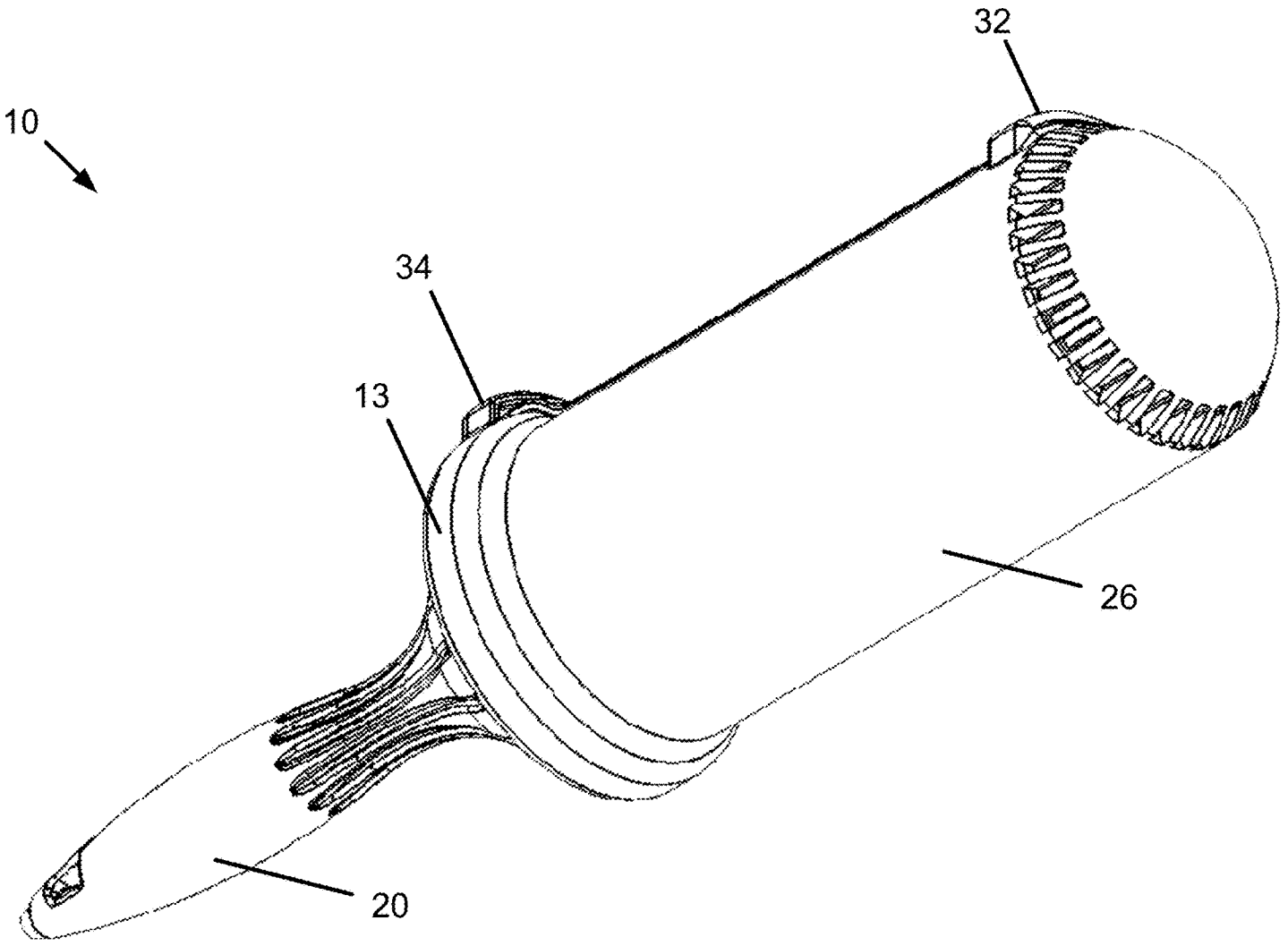
FIG. 2 is another perspective view of the apparatus of FIG. 1.
Figure 5:
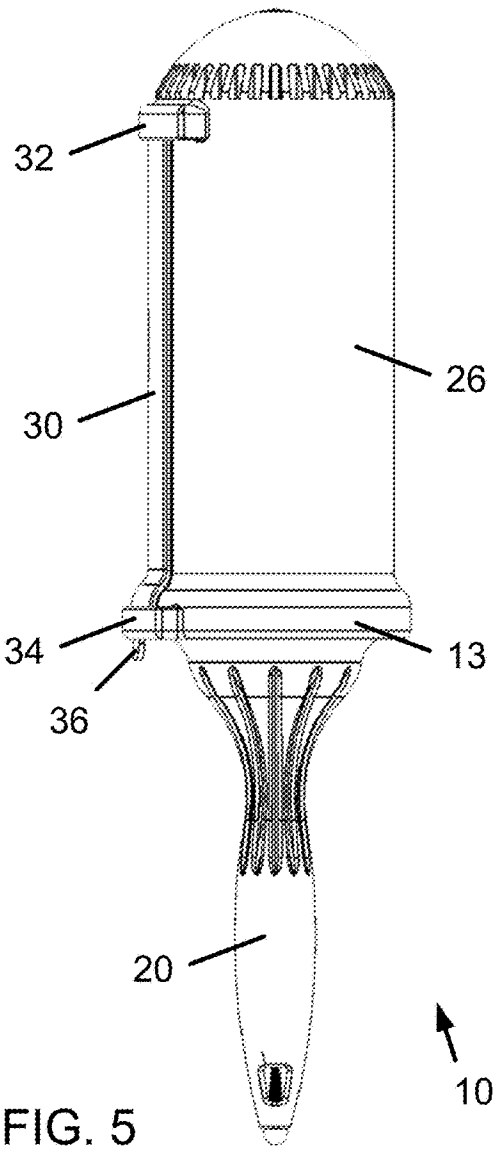
FIG. 5 is a third elevational view of the apparatus of FIG. 1.
Figure 4:
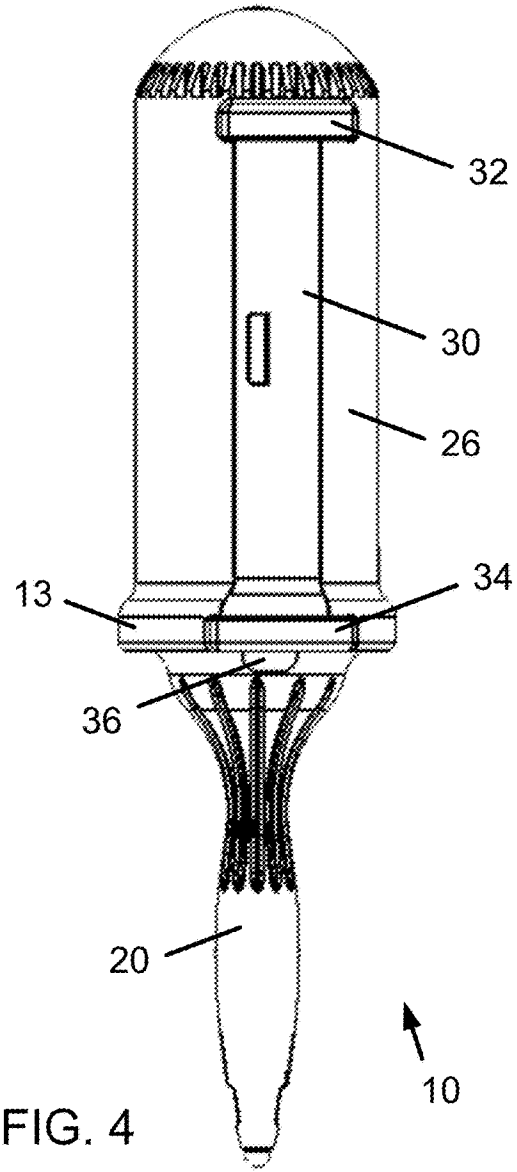
FIG. 4 is a second elevational view of the apparatus of FIG. 1.
Figure 3:
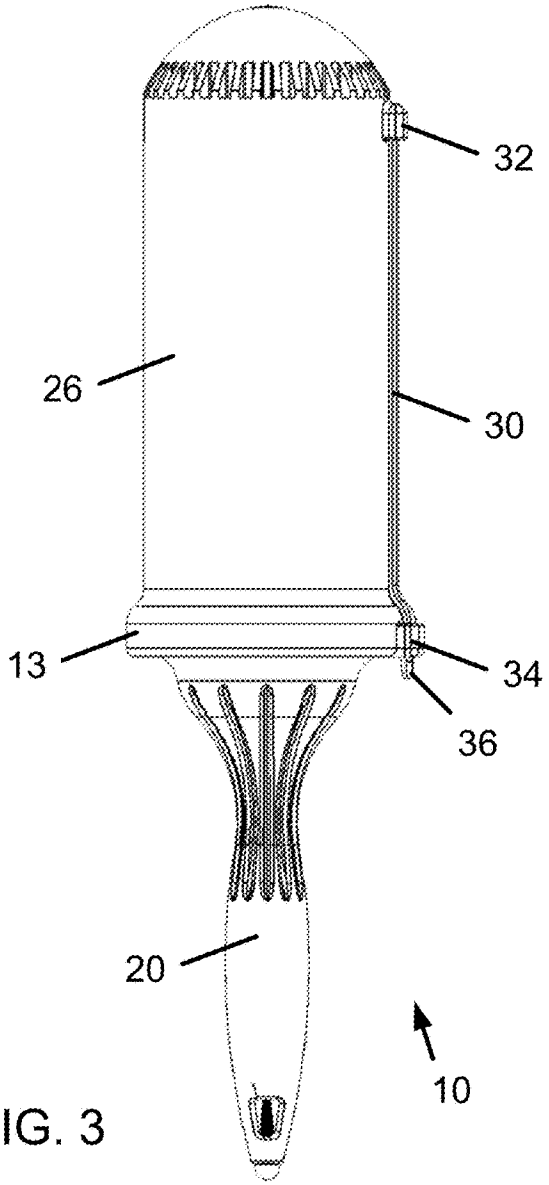
FIG. 3 is a first elevational view of the apparatus of FIG. 1.
Figure 6:
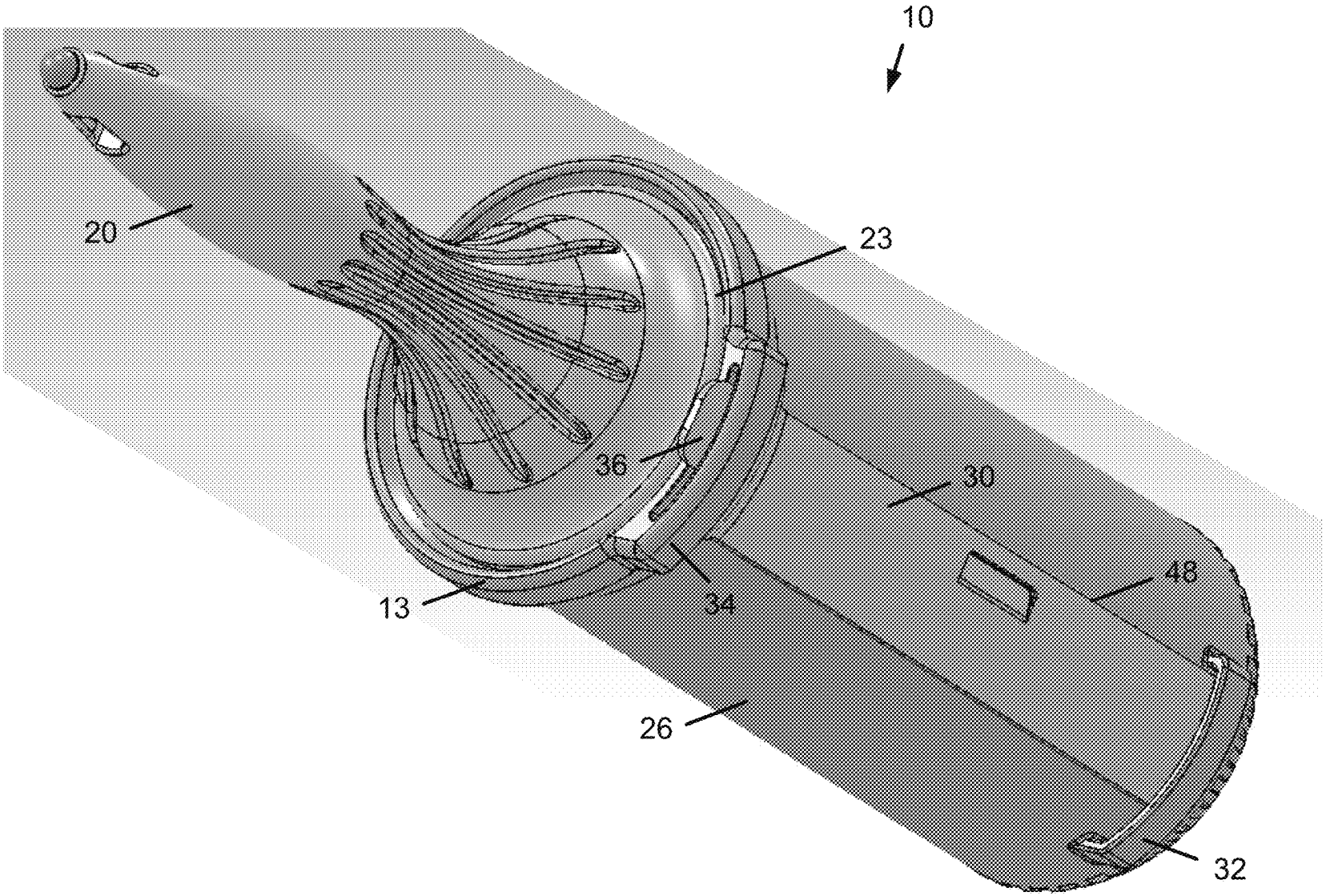
FIG. 6 is another perspective view of the apparatus of FIG. 1.
Figures 7, 8, 9, 10, 11, 12:
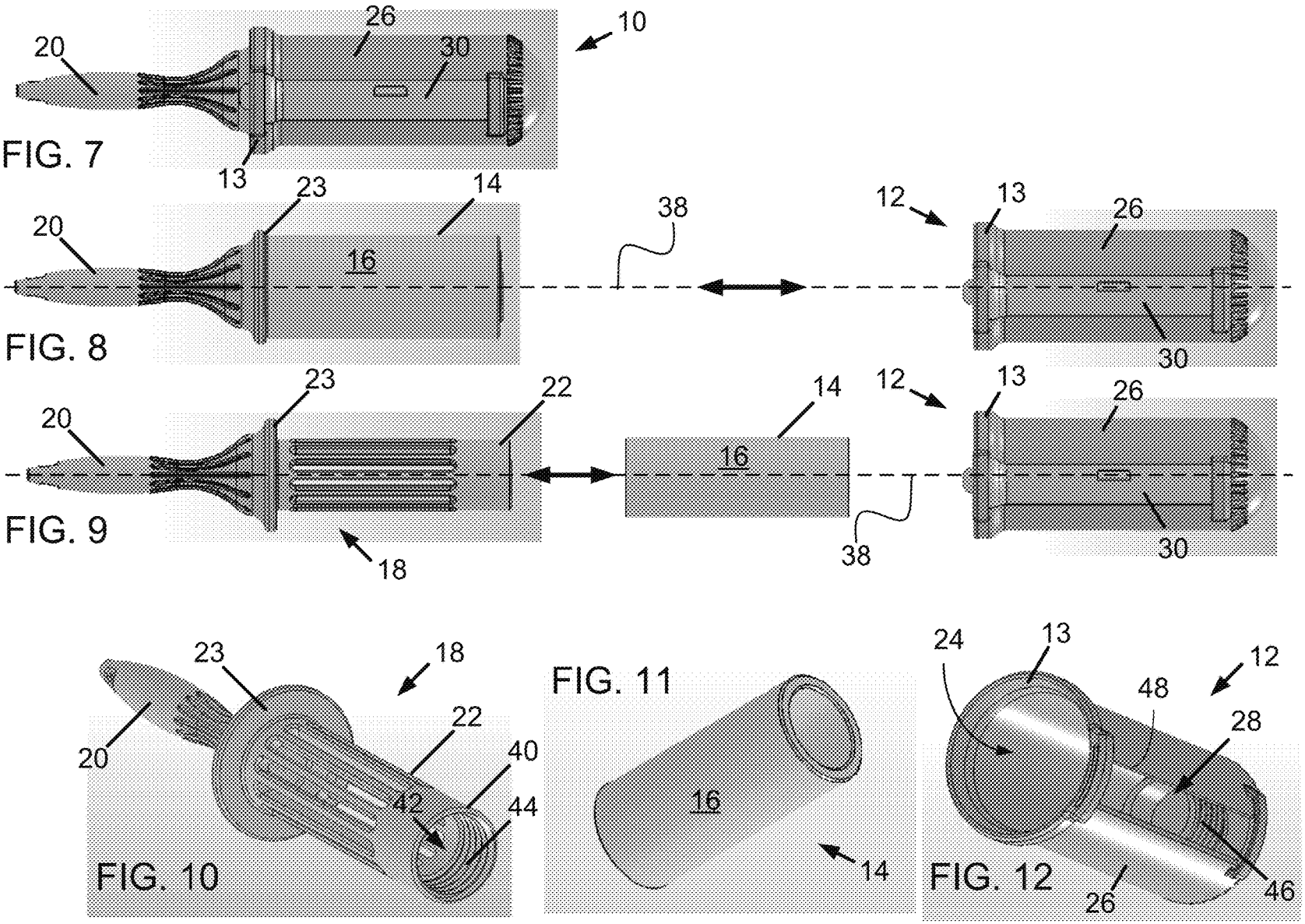
FIG. 7 is another elevational view of the apparatus of FIG. 1, which view is similar to that of FIG. 4.
FIG. 8 is a partially exploded view of the apparatus of FIG. 1.
FIG. 9 is an additional exploded view of the apparatus of FIG. 1.
FIG. 10 is a perspective view of a component of the apparatus of FIG. 1.
FIG. 11 is a perspective view of another component of the apparatus of FIG. 1.
FIG. 12 is a perspective view of another component of the apparatus of FIG. 1.

With reference now generally to FIGS. 1-7, an apparatus for applying a wrap is seen from different views. Specifically, FIG. 1 is a perspective view of the apparatus 10; FIG. 2 is another perspective view of the apparatus 10; FIG. 3 is a first elevational view of the apparatus 10; FIG. 4 is a second elevational view of the apparatus 10; FIG. 5 is a third elevational view of the apparatus 10; FIG. 6 is another perspective view of the apparatus 10; and FIG. 7 is another elevational view of the apparatus 10 like the view of FIG. 4. Furthermore, FIG. 8 is a partially exploded view of the apparatus 10 showing the detachment of a first tubular attachment 12, and FIG. 9 is an additional exploded view of the apparatus 10 showing the detachment of a roll 14 of material 16 from an elongate member 18 comprising a handle 20 and an arbor 22.

As first seen in FIG. 9, the apparatus 10 comprises an elongate member 18 having a proximal end and a distal end. The elongate member 18 further comprises both a handle 20 for grasping by hand that extends from the proximal end in a direction toward the distal end, and an arbor 22 for receiving the roll 14 of material 16, which arbor 22 extends from the distal end in a direction toward the proximal end.

Preferably, the handle 20 and the arbor 22 collectively are defined by a single piece of injection molded material, whereby the handle 20 and arbor 22 are integrally formed. Furthermore, a base 23 also preferably is defined by the single piece of injection molded material, from which base 23 the arbor 22 extends, and against which base 23 the open end 13 of the first tubular attachment 12 preferably abuts when the first tubular attachment 12 is attached to the elongate member 18.

FIG. 10 further reveals that the first tubular attachment 12 has an open end 24 and defines an interior space for receiving the arbor 22 therein; and that the first tubular attachment 12 comprises both an outer wall 26 that defines a slot 28 having an opening for passage through the slot 28 from the interior space, and a panel 30 that is slidable between an open configuration for providing passage through the slot 28, and a closed configuration for blocking passage through the slot 28. The panel 30 is mounted to the outer wall for sliding relative thereto by retention of opposite ends of the panel 30, namely, by retention member 32 and retention member 34, with each retention member 32,34 defining a channel within which a respective end of the panel 30 is received. Furthermore, the panel 30 includes a thumb tab 36 extending below the retention member 34, by which the panel 30 may be slid between the open and closed configurations using the thumb of a hand when grasping the handle 20. The first tubular attachment 12 further preferably comprises an edge 48 along a portion of the slot opening that facilitates cutting of the material 16 when the panel 30 is slid into the closed configuration with unwound material 16 passing through the slot 28. This should keep the roll 14 from getting wrinkled or unnecessarily unwinding during application of wraps.

Furthermore, in a salon or spa setting wraps may be damaged by moisture or nicks. The tubular attachment 12 preferably completely covers and protects the roll 14 of material from moisture and nicks. It also will be appreciated that during use, the tubular attachment 12 also keeps the material 16 of the roll 14 from clinging back onto itself during dispensing when such material is prone to exhibiting such clinging.

It will be appreciated from FIGS. 8 and 9 that the exploded views of the apparatus 10 are along a longitudinal axis 38 of the elongate member 18. The handle 20 and arbor 22 preferably are coaxial with respect to the axis 38.

FIG. 10 is a perspective view of the elongate member 18 and reveals that a portion 40 of the distal end of the elongate member 18 comprises a circular opening 42. A center of the circular opening 42 is located on the longitudinal axis 38, whereby the circular opening 42 also is coaxial with the handle 20 and the arbor 22.

As further seen in FIG. 10, an inner surface of the portion 40 of the elongate member 18 defining the circular opening 42 includes threads 44 that define a threaded female fastening mechanism.

FIG. 11 is a perspective view of the roll 14 of material 16. The material 16 preferably comprises a film, a metal foil, or a paper that is suitable for use in hair and body wraps.

FIG. 12 is a perspective view of the first tubular attachment 12, wherein the panel 30 is omitted for viewing of an interior surface at a distal end thereof that includes threads 46 that define a threaded male fastening mechanism. The threaded male fastening mechanism extends toward the open end of the first tubular attachment; is seen to comprise a cylindrical wall having an outer threaded surface—but could alternatively be a threaded shaft if desired; and is complementary to the threaded female fastening mechanism of the elongate member 18 insofar as it is configured to mate with the threaded female fastening mechanism of the elongate member 18 when the first tubular attachment is in covering relation both to the arbor 22 and the roll 14 of material 16 received thereon.

Figure 13:
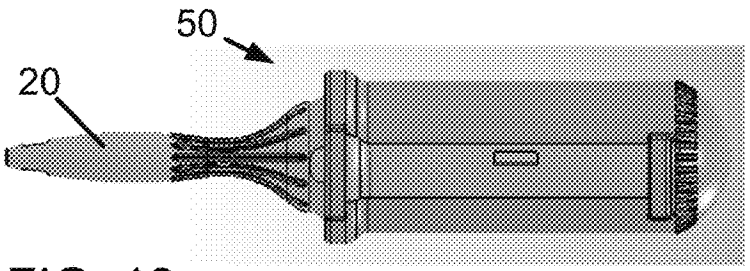
FIG. 13 is a perspective view of another apparatus in accordance with a preferred embodiment of one or more aspects and features of the invention.
Figure 14:
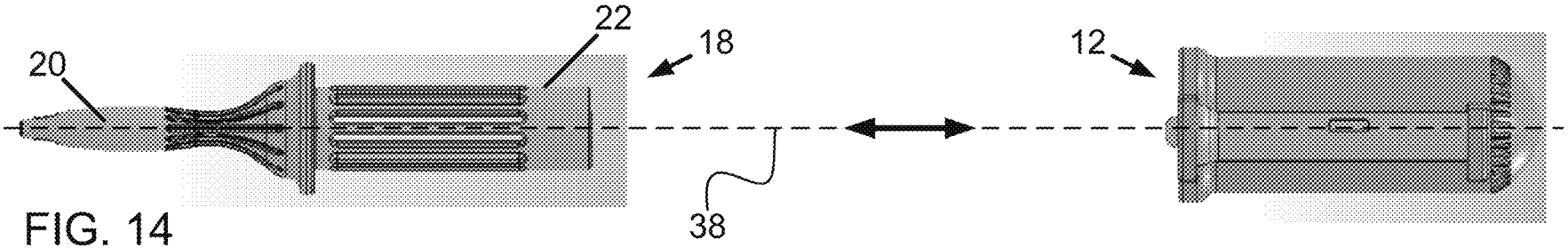
FIG. 14 is an exploded view of the apparatus of FIG. 13.

FIG. 13 is a perspective view of another apparatus 50 in accordance with a preferred embodiment of one or more aspects and features of the invention, and FIG. 14 is an exploded view of the apparatus of FIG. 13. Apparatus 50 is the same as apparatus 10 with the exception that the roll 14 of material 16 is omitted. It is contemplated that apparatus 50 may be made, sold, and offered for sale without the roll 14, and that a roll 14 may be combined with apparatus 50 to form apparatus 10 at some point thereafter, at which time wraps can be applied in accordance with one or more aspects and features of the invention.

Figure 19:
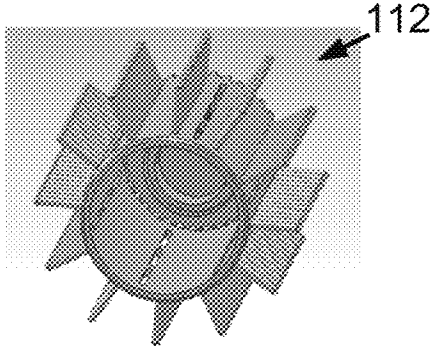
FIG. 19 is another perspective view of the component of FIG. 15.
Figure 17:
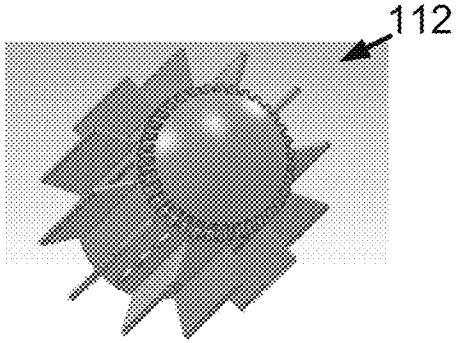
FIG. 17 is another perspective view of the component of FIG. 15.
Figure 18:
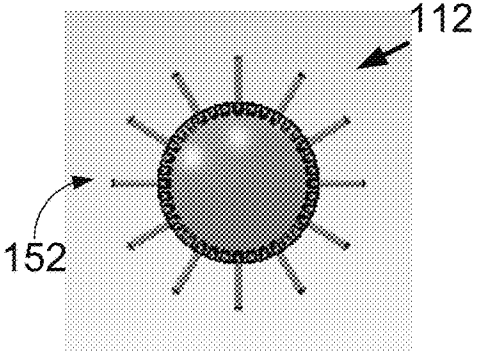
FIG. 18 is a top plan view of the component of FIG. 15.
Figure 15:
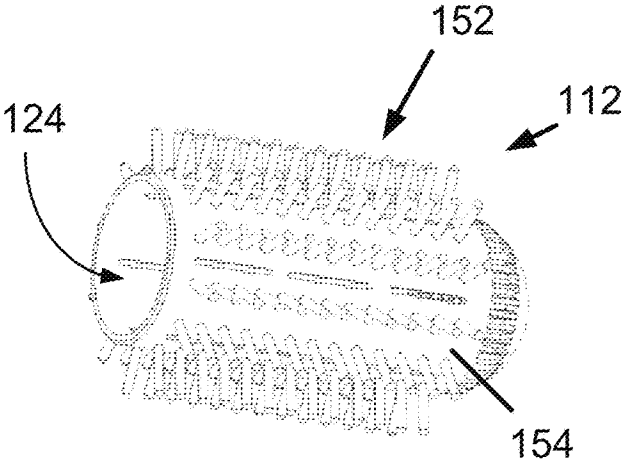
FIG. 15 is a perspective view of a component of an apparatus in accordance with a preferred embodiment of one or more aspects and features of the invention.
Figure 16:
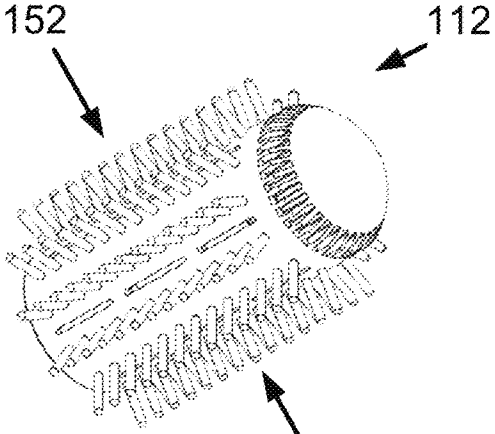
FIG. 16 is another perspective view of the component of FIG. 15.

FIG. 15 is a perspective view of another tubular attachment 112 in accordance with a preferred embodiment of one or more aspects and features of the invention. Similarly, FIG. 16 is another perspective view of the tubular attachment 112; FIG. 17 is another perspective view of the tubular attachment 112; FIG. 18 is a top plan view of the tubular attachment 112; FIG. 19 is another perspective view of the tubular attachment 112; and FIG. 20 is a bottom plan view of the tubular attachment 112.

As seen in FIGS. 15-20, the tubular attachment 112 has an open end 124 and defines an interior space which is configured to receive therein the arbor 22. Preferably, the interior space defined by the tubular attachment 112 is configured to receive therein the arbor 22 with a roll of material received on the arbor; however, it is contemplated that the interior space defined by the tubular attachment 112 is configured to receive therein only the arbor 22 without a roll of material received thereon. The tubular attachment 112 further comprises a plurality 152 of elongate protuberances, each having a distal end extending from an outer surface 154 of the tubular attachment 112.

Figure 20:
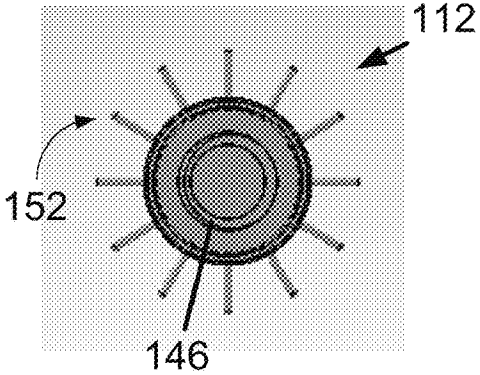
FIG. 20 is a bottom plan view of the component of FIG. 15.
Figure 21:
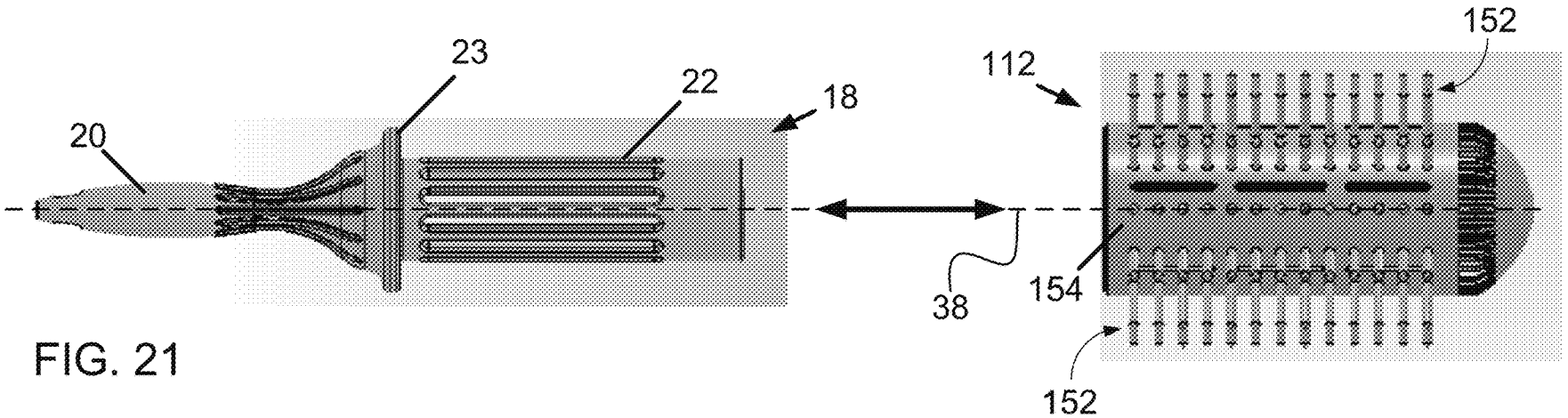
FIG. 21 is an exploded view of another apparatus in accordance with a preferred embodiment of one or more aspects and features of the invention.
Figure 23:
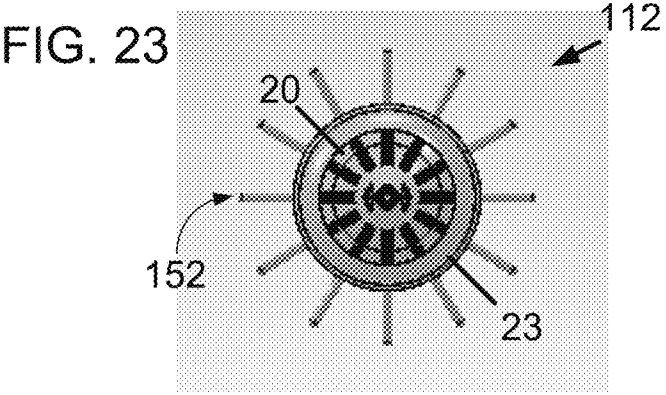
FIG. 23 is a bottom plan view of the apparatus of FIG. 22.
Figure 22:
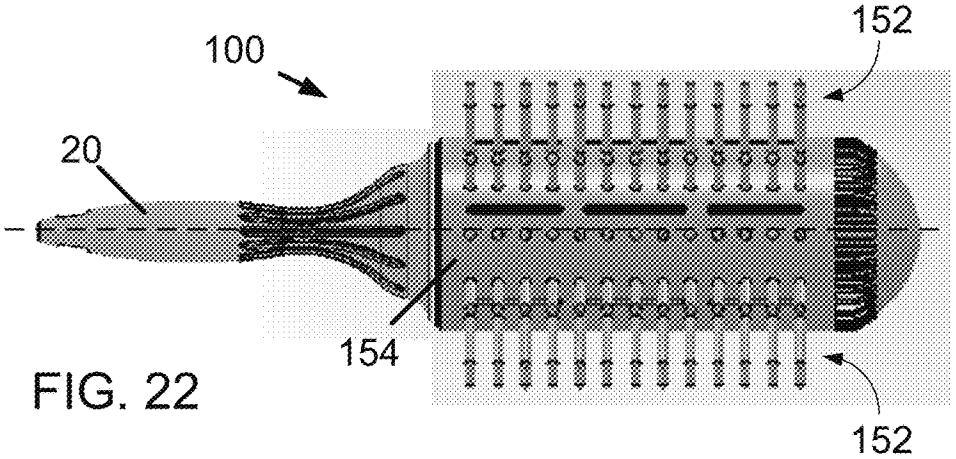
FIG. 22 is an elevational view of the apparatus of FIG. 21.

Additionally, as seen in FIG. 20, the tubular attachment 112 comprises an interior surface at a distal end thereof that includes threads 146 that define a threaded male fastening mechanism. The threaded male fastening mechanism extends toward the open end 124 of the tubular attachment 112 and comprises a cylindrical wall having an outer threaded surface—but could alternatively be a threaded shaft if desired, and is complementary to the threaded female fastening mechanism of the elongate member 18 insofar as it is configured to mate with the threaded female fastening mechanism of the elongate member 18 when the tubular attachment 112 is in covering relation to the arbor 22. The plurality 152 of protuberances preferably comprise bristles for a hairbrush, and when the tubular attachment 112 is releasably mounted to the elongate member 18, the resulting apparatus 100 preferably forms a hairbrush for brushing hair. Such combination is illustrated in FIGS. 21 and 22, wherein FIG. 21 is an exploded view along longitudinal axis 38, and FIG. 22 is an elevational view of the resulting round hairbrush after mounting. Additionally, FIG. 23 is a bottom plan view of the resulting apparatus looking along the axis 38 in a direction from the handle 20 toward the tubular attachment 112.

In view of the foregoing, it should be appreciated that the first tubular attachment 12 and the second tubular attachment 112 are interchangeable with one another, and further that the releasable mounting of the first tubular attachment 12 and the releasable mounting of the second tubular attachment 112 are mutually exclusive.

It is contemplated that the tubular attachment 112 may be offered for sale or sold separately from the elongate member 18, or that the tubular attachment 112 may be offered for sale or sold in combination with the elongate member 18 as a hairbrush. In such scenarios, and separately therefrom, the tubular member 12 may be offered for sale or sold separately; the roll 14 of material 16 may be offered for sale or sold separately; and the tubular member 12 and elongate member 18 may be offered for sale or sold together.

Figure 24:
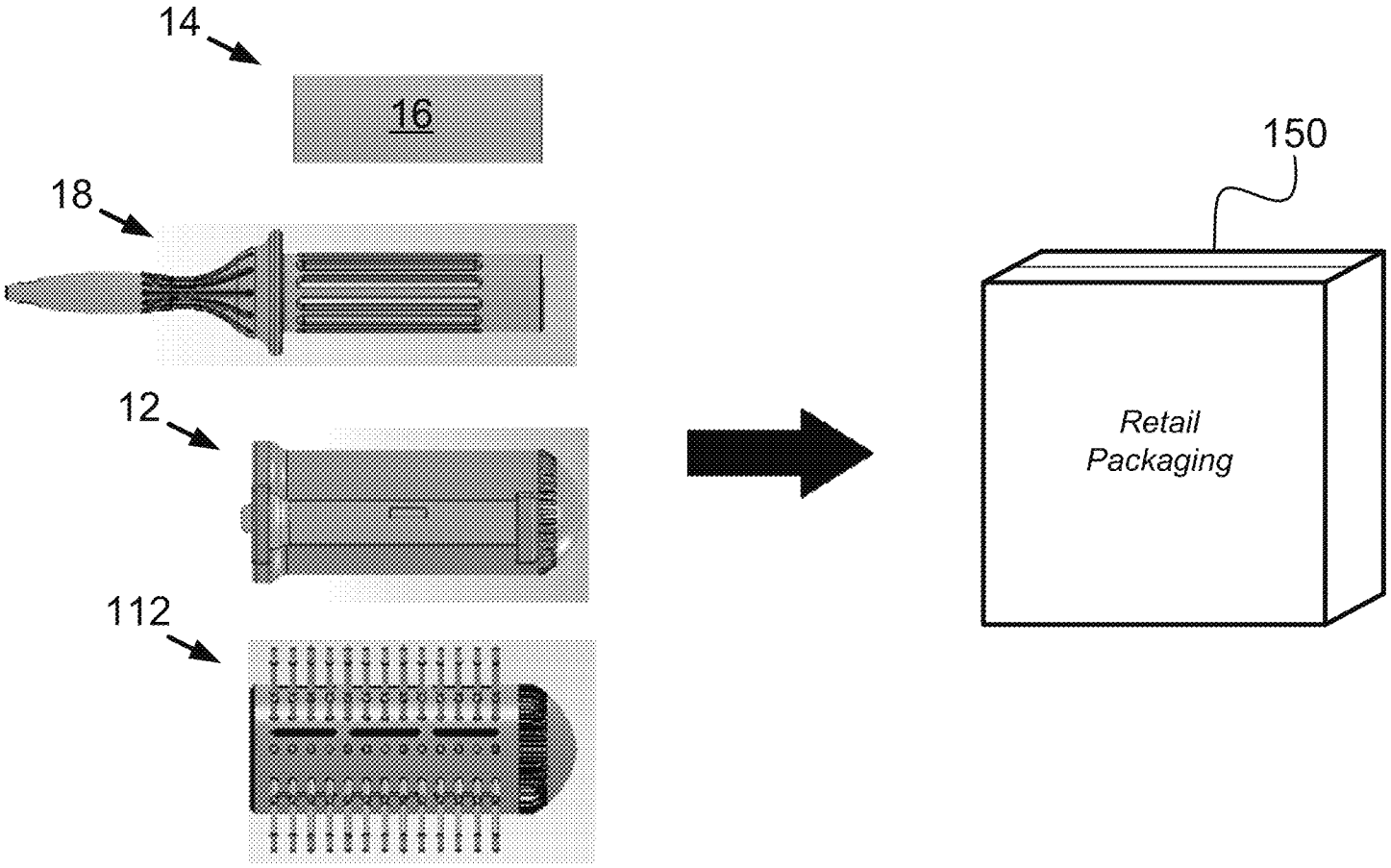
FIG. 24 is an illustration of retail packaging comprising components of an apparatus in accordance with one or more preferred embodiments of one or more aspects and features of the invention.

Additionally, as illustrated in FIG. 24, it is contemplated that the foregoing components may be packaged together into a box 150 as a kit for retail sale, the components comprising the elongate member 18, the first tubular attachment 12, the second tubular attachment 112, and a role 14 of material 16, each component in any desired number.

From the foregoing, and in accordance with preferred commercial implementations, the brush apparatus is used for applying wraps during hair styling including highlighting, coloring, conditioning, and drying. It is believed that the brush apparatus will enable a stylist or other service provider a more aesthetically pleasing and more efficient way of applying wraps in a salon setting as well as in a spa setting. The brush apparatus further comprises a handle and arbor that are combinable with different screw-on attachments, including a brush attachment and a wrap attachment. The handle looks and feels like a regular brush handle and preferably is made of plastic, rubber, or other materials. Each attachment may be made of plastic, rubber, or other materials, too. The brush is used with one hand leaving a stylist a free hand to manage the hair. Furthermore, when consumers and stylists travel, the brush apparatus is portable and lightweight thereby making such travel and styling on the go relative easy.

Based on the foregoing description, it will be readily understood by those persons skilled in the art that the invention has broad utility and application. Many embodiments and adaptations of the invention other than those specifically described herein, as well as many variations, modifications, and equivalent arrangements, will be apparent from or reasonably suggested by the invention and the foregoing descriptions thereof, without departing from the substance or scope of the invention.

Accordingly, while the invention has been described herein in detail in relation to one or more preferred embodiments, it is to be understood that this disclosure is only illustrative and exemplary of the invention and is made merely for the purpose of providing a full and enabling disclosure of the invention. The foregoing disclosure is not intended to be construed to limit the invention or otherwise exclude any such other embodiments, adaptations, variations, modifications or equivalent arrangements, the invention being limited only by the claims appended hereto and the equivalents thereof.

What is claimed is:

1. A hair treatment system, comprising:

(a) an elongate member having a proximal end and a distal end, and comprising (i) a handle for grasping by hand and extending from the proximal end in a direction toward the distal end, and (ii) an arbor for receiving a roll of material and extending from the distal end in a direction toward the proximal end;

(b) a roll of material received on the arbor and configured to rotate on the arbor during unwinding of material from the roll;

(c) a first tubular attachment having an open end and defining an interior space for receiving therein the arbor, with the roll of material received on the arbor, the first tubular attachment being configured for dispensing material from the roll and comprising a surface defining a slot having an opening for passage of the material through the slot from the interior space during unwinding of the roll, and a panel slidable between an open configuration for providing passage of the material through the slot during unwinding of the roll, and a closed configuration for blocking passage of the material through the slot; and (d) a second tubular brush head attachment having an open end and defining an interior space for receiving therein the arbor, the second tubular brush head attachment configured for brushing hair and comprising a plurality of elongate protuberances each having a distal end extending from a surface of the second tubular brush head attachment;

(e) wherein the first tubular attachment and the second tubular brush head attachment are configured for releasable mounting to the elongate member and are interchangeable with one another.

2. The apparatus of claim 1, wherein the releasable mounting of the first tubular attachment and the releasable mounting of the second tubular brush head attachment are mutually exclusive.

3. The apparatus of claim 1, wherein the handle and the arbor collectively are defined by a single piece of molded material.

4. The apparatus of claim 1, wherein the distal end of the elongate member comprises a first threaded fastener and wherein a distal end of the first tubular attachment comprises a second, complementary threaded fastener configured to mate with the first threaded fastener.

5. The apparatus of claim 1, wherein the distal end of the elongate member comprises a first threaded fastener and wherein a distal end of the second tubular brush head attachment comprises a second, complementary threaded fastener configured to mate with the first threaded fastener.

6. The apparatus of claim 1, wherein the distal end of the elongate member comprises a first threaded fastener; wherein a distal end of the first tubular attachment comprises a second, complementary threaded fastener configured to mate with the first threaded fastener; and wherein a distal end of the second tubular brush head attachment comprises a third, complementary threaded fastener configured to mate with the first threaded fastener.

7. The apparatus of claim 6, wherein the first threaded fastener comprises a threaded female fastener, and wherein the second and third threaded fasteners each comprises a threaded male fastener.

8. The apparatus of claim 7, wherein the threaded female fastener comprises an opening and interior threaded walls, and wherein the second and third threaded fasteners each comprises a threaded shaft.

9. The apparatus of claim 7, wherein the threaded female fastener comprises an opening and interior threaded walls, and wherein the second and third threaded fasteners each comprises a cylindrical wall having an outer threaded surface.

10. The apparatus of claim 7, wherein the second threaded fastener extends from an interior surface at a distal end of the first tubular attachment toward the open end of the first tubular attachment; and wherein the third threaded fastener extends from an interior surface at a distal end of the second tubular brush head attachment toward the open end of the second tubular brush head attachment.

11. The apparatus of claim 1, wherein the handle and the arbor are coaxial with respect to a longitudinal axis of the elongate member.

12. The apparatus of claim 11, wherein a portion of the distal end of the elongate member comprises a circular opening with a center located on the longitudinal axis.

13. The apparatus of claim 12, wherein an inner surface of the portion of the elongate member defining the circular opening is threaded and is configured to receive a threaded portion of the first tubular attachment when the first tubular attachment is in covering relation to the arbor and the roll of material received thereon.

14. The apparatus of claim 12, wherein an inner surface of the portion of the elongate member defining the circular opening is threaded and is configured to receive a threaded portion of the second tubular brush head attachment.

15. The apparatus of claim 1, further comprising a base from which the arbor extends and which the open end of the first tubular attachment abuts when attached to the distal end of the elongate member.

16. The apparatus of claim 15, wherein the open end of the second tubular brush head attachment abuts the base when attached to the distal end of the elongate member.

17. The apparatus of claim 1, wherein the first tubular attachment comprises an edge defining a portion of the slot opening and configured to facilitate cutting of the material when the panel is slid into the closed configuration with unwound material passing through the slot.

18. The apparatus of claim 1, wherein the interior space defined by the second tubular brush head attachment is configured to receive therein the arbor with the roll of material received on the arbor.

* * * * *